US005286222A

United States Patent [19]

Yagi et al.

[11] Patent Number: 5,286,222

[45] Date of Patent: Feb. 15, 1994

[54] SHIELDED FLOATING ELECTRIC CONNECTOR

[75] Inventors: Masanori Yagi, Sagamihara; Kazurou Yamada, Tokyo, both of Japan

[73] Assignee: Molex Incorporated, Lisle, Ill.

[21] Appl. No.: 977,941

[22] Filed: Nov. 18, 1992

[30] Foreign Application Priority Data

Nov. 18, 1991 [JP] Japan ..... 3-329482

[51] Int. Cl.[5] ..... H01R 13/658

[52] U.S. Cl. ..... 439/607; 439/609; 439/248; 439/557

[58] Field of Search ..... 439/607-610, 439/247, 248, 374, 557

[56] References Cited

U.S. PATENT DOCUMENTS

| | | | |
|---|---|---|---|
| 4,820,180 | 4/1989 | Mosquera et al. | 439/248 |
| 4,988,308 | 1/1991 | Toedtman | 439/248 |
| 5,017,151 | 5/1991 | Peterson | 439/248 |
| 5,041,011 | 8/1991 | Chiang | 439/607 |
| 5,052,948 | 10/1991 | Hyzin | 439/609 |

FOREIGN PATENT DOCUMENTS

| | | | |
|---|---|---|---|
| 1188381 | 6/1985 | Canada | 439/609 |
| 59-12583 | 1/1984 | Japan . | |
| 2-115282 | 9/1990 | Japan . | |

*Primary Examiner*—Gary F. Paumen
*Attorney, Agent, or Firm*—Charles S. Cohen

[57] ABSTRACT

Disclosed is an improved floating electric connector comprising male and female counterparts each having a housing and a metal shell. The male housing has a plurality of electric signal transmission male terminals fitted therein whereas the female terminals fitted therein. Each metal shell has a blade contact integrally connected thereto for inserting an associated female terminal. The metal shell-and-blade contact integral structure permits the simultaneous grounding and destaticizing.

3 Claims, 7 Drawing Sheets

SHIELDED FLOATING ELECTRIC CONNECTOR

FIELD OF THE INVENTION

The present invention relates to electric connectors and, more particularly, to a floating electric connector structure which permits grounding of associated electric apparatuses and discharging of static electricity.

BACKGROUND OF THE INVENTION

As is well known, the male counterpart or plug of an electric connector is attached to an electric apparatus and the female counterpart or receptacle of the electric connector is attached to another electric apparatus to permit transmission of electric signals from one to the other when the plug and receptacle are mated together. A variety of such electric connectors are widely used.

As a matter of necessity, many such electric apparatuses require grounded electric connectors. At the same time, the static electricity can be discharged from a person handling the electric connector to an appropriate conductive object, thereby shielding the terminals of the electric connector.

A conventional electric connector often has some extra grounding terminals other than electric signal transmission terminal pins, and the electric connector has a metal shield attached to its terminal housing for permitting the discharging of the static electricity from a person handling the electric connector at the time of coupling the plug to the receptacle of the electric connector.

As described, the conventional electric connector has different and separate elements allotted to grounding and destaticizing respectively. This leads to the following disadvantages: an increase in the number of parts to be assembled because of the elements used for grounding and destaticizing are duplicated; the increased number of parts each of the plug and receptacle limits reduction of the connector size; and the increased number of parts makes it difficult to improve the efficiency of manufacturing the connector.

Such structure becomes further complicated when the connector is intended to be mounted to an apparatus in a floating manner.

SUMMARY OF THE INVENTION

In view of the above, one object of the present invention is to provide a floating electric connector which uses only one common part for grounding and destaticizing, thus reducing the number of the parts of the connector and its size.

To attain this object, a floating electric connector comprising a base to be attached to an electric apparatus, and a housing having a plurality of electric signal transmission terminals fitted therein, is improved according to the present invention in that the housing has a metal shell attached therearound. The metal shell extends beyond the tips of said electric signal transmission terminals and has an extended planar blade contact integrally connected to the metal shell for mating with an associated female terminal. This arrangement permits the metal shells of a plug and receptacle to ground associated electric apparatuses and, at the same time, destaticize a person handling the electric connector. The common use of the metal shells of the plug and receptacle for grounding and destaticizing permits reduction of the number of the parts of the connector counterpart and improvement of the efficiency of assembly.

An electric connector counterpart may be a female counterpart or receptacle; said housing and metal shell may be of a square shape; and a first pair of spring fingers are integrally connected to and bent inside of opposite walls of said metal shell to make an electrical contact with the metal shell of an associated male counterpart or plug when mated together whereas a second pair of spring fingers are intrically connected to and bent inside of the remaining opposite walls of said metal shell to fix said female counterpart or receptacle to the housing of said male counterpart or plug when mated together. The resiliency of these spring fingers assures a good electrical contact between the male and female counterparts and a are reliable mechanical coupling between these counterparts. Numerous repetitions of coupling and decoupling of the male and female counterparts will not lower the resiliency of these spring fingers.

The first pair of spring fingers may be bent and laid on the lead-in surfaces of said opposite walls of said metal shell. This facilitates the leading of the plug into the receptacle when mated.

The first pair of contact-making spring fingers and the second pair of holding spring fingers may be fitted in the recesses made on the edges of the walls of said metal shell, and may be bent inside of said housing. With this arrangement the upper edge of the metal shell of the receptacle housing is flush with the bent spring fingers.

An electric connector counterpart may be a male counterpart or plug; and said housing and metal shell may be of a square shape. The housing may have a recess made on the top exterior surface of each wall of said housing to accommodate the folded edge of each spring fingers of said metal shell. The metal shell of the plug housing may have an planar blade contact integrally connected thereto, extending horizontally apart from said metal shell and depending vertically from the end of the horizontally extending length. An electric connector may comprise a female counterpart or receptacle and a male counterpart or plug as described above.

In use, the plug and receptacle, each of which have its planar blade contact coupled to an associated female terminal for grounding, are mated together with the housing of the plug inserted in the hollow housing of the receptacle. Extension of the metal shell of the plug housing beyond the electrical transmission male terminals of the plug permits the discharging of the static electricity of a person handling the electric connector to the metal shells of the plug and receptacle when mated together, and at the same time the grounding of associated electric apparatuses through the metal shells of the plug and receptacle thus mated together. Thus, the metal shells of the plug and receptacle of the electric connector permit simultaneous grounding and destaticizing through the common parts of the electric connector.

Other objects and advantages of the present invention will be understood from the following description of electric connector counterparts according to a preferred embodiment of the present invention, which is shown in accompanying drawings.

DETAILED DESCRIPTION OF THE PREFERRED EMBODIMENT

Figure 1:
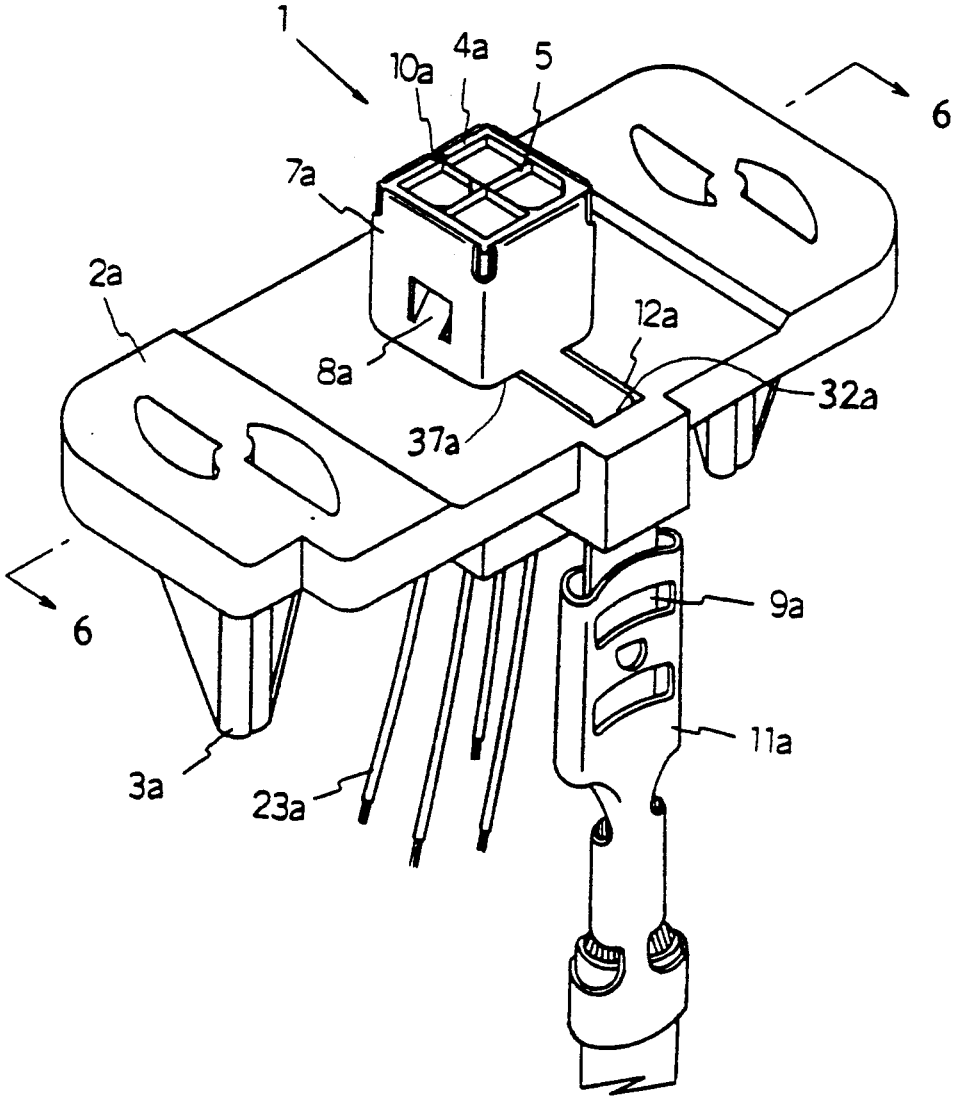
FIG. 1 is a perspective view of a male plug connector according to the present invention.

FIG. 1 shows a male plug connector 1 according to the present invention. It has a rectangular base 2*a*, and the base 2*a* has attaching means 3*a* on its rear surface for fixing the plug to a panel, a board or a housing of an associated electric apparatus in a floating condition. The attaching means shown in the Figures is similar to those disclosed in U.S. Pat. No. 4,988,308 and U.S Pat. No. 5,017,151, each of which is assigned to the assignee of the present invention and incorporated by reference herein. Such attaching means utilizes a post have a pair of spiral vanes that resiliently collapse to permit insertion into a hole in a board or panel and then spring back to floatingly retain the connector to the board or panel.

Figure 3:
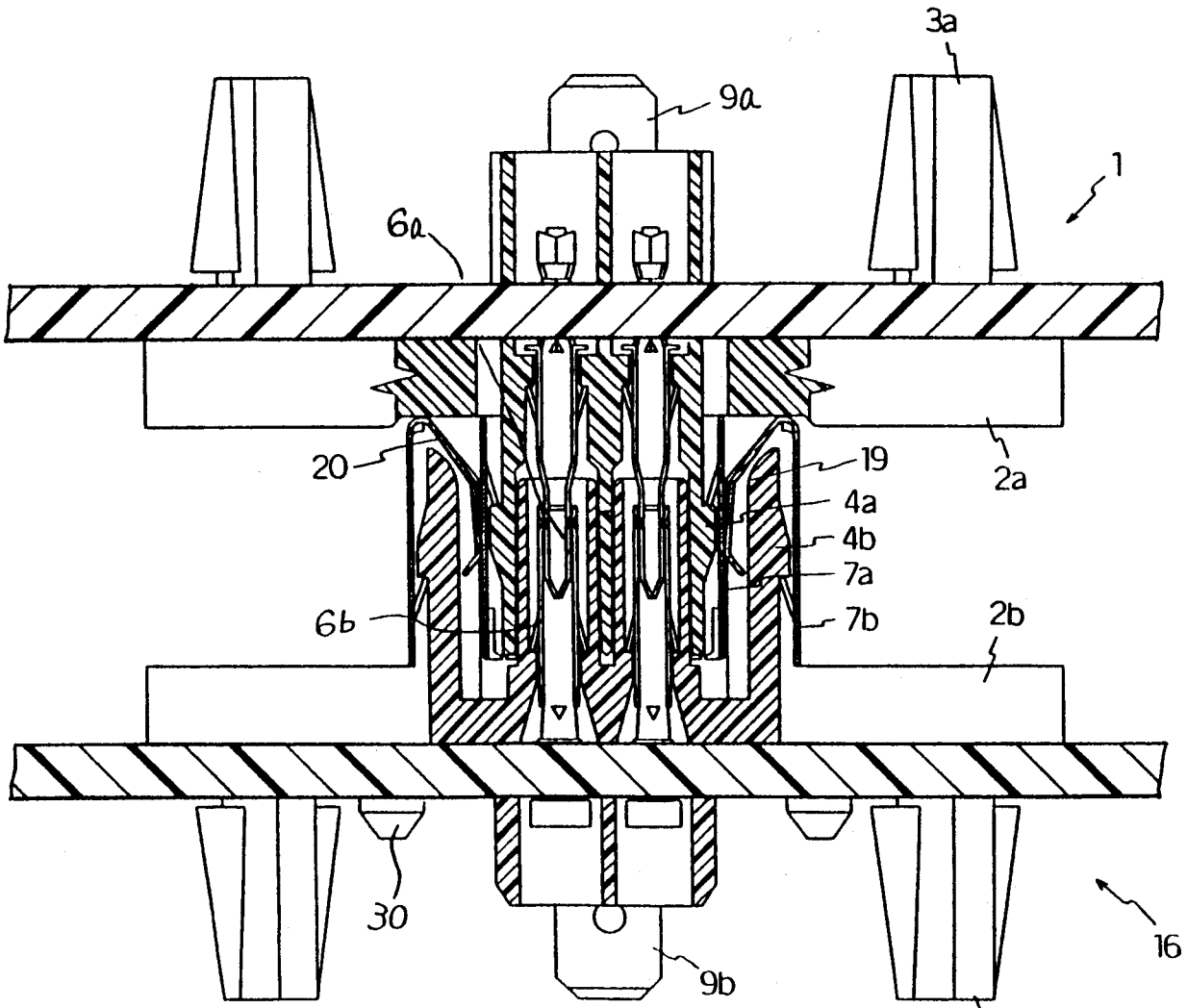
FIG. 3 is a longitudinal section showing the plug and receptacle mated together.
Figure 4:
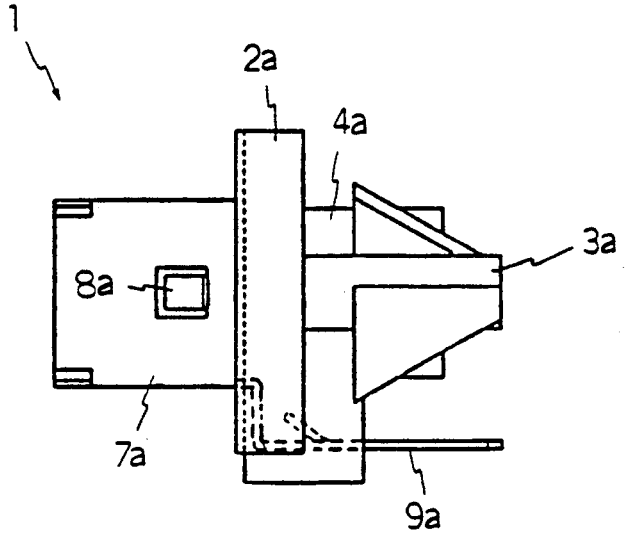
FIG. 4 is a side view of the plug.
Figure 5:
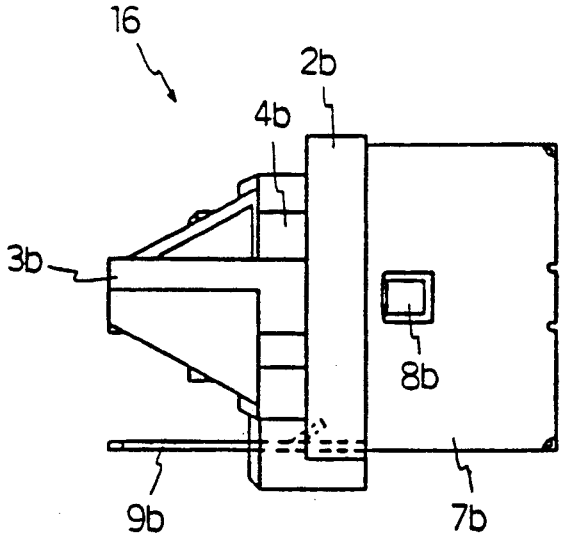
FIG. 5 is a side view of the receptacle.

The plug has a square terminal housing 4*a* on the center of the front surface of the body 2*a*. As seen from the drawing, the square housing 4*a* has four square sections, and each section has an electrical signal transmission male terminal 6*a* (FIG. 3). The base 2*a*, attaching means 3*a* and square housing 4*a* are made of insulative material such as plastic.

Figure 6:
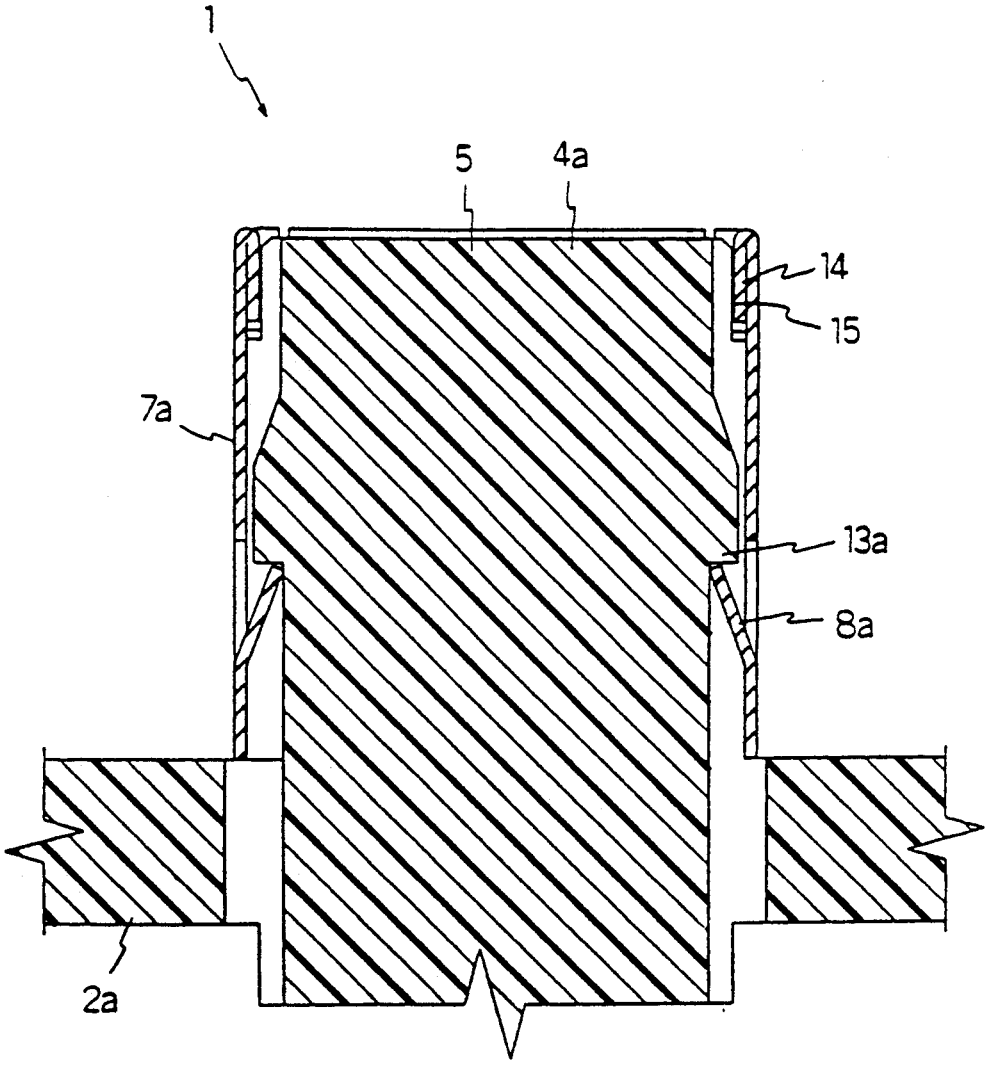
FIG. 6 is a longitudinal section of the plug taken along line 6—6 in FIG. 1.

The square housing 4*a* has a surrounding square metal shell 7*a*. This square metal shell 7*a* may be made by folding sheet metal to enclose the square housing 4*a*, and the metal shell 7*a* has two opposite tongues 8*a* cut and bent inward on its opposite sides. These tongues 8*a* will be caught by the corresponding projections 13*a* of the square housing 4*a* when the metal shell 7*a* is press-fitted around the square housing 4*a* (FIG. 6). The square shell 7*a* has a metal blade contact 12*a* integrally connected thereto, as described later in detail. The metal shell 7*a* is press-fitted around the square housing 4*a* with the joint 10*a* of the metal shell positioned opposite to its blade contact 12*a*.

As best seen in FIG. 3, the metal shell 7*a* extends beyond the electrical signal transmission male terminals 6*a* so that any electrostatic discharge is received by the shell rather than the terminals, and the end 9*a* of blade contact 12*a* of the metal shell 7*a* can be mated with associated female terminal 11*a*. As seen from FIG. 1, the blade contact 12*a* extends horizontally from the bottom edge 37*a* of the metal shell 7*a* on the base 2*a*, and the tab terminal 12*a* passes through the tab holding slot 32*a* of the base 2*a*, depending down vertically from the base 2*a* and mating with the female terminal 11*a* for electrical connection. As seen from FIG. 6, the square housing 4*a* has a recess 15 surrounding its upper outer surface to provide enough space to accommodate the folded upper edge 14 of the metal shell 7*a*.

Electrical signal transmission male terminals 6*a* in the plug housing 4*a* are connected to conductors 23*a* to transmit electrical signals to an associated electrical apparatus, to which the plug 1 is secured in floating condition.

Figure 2:
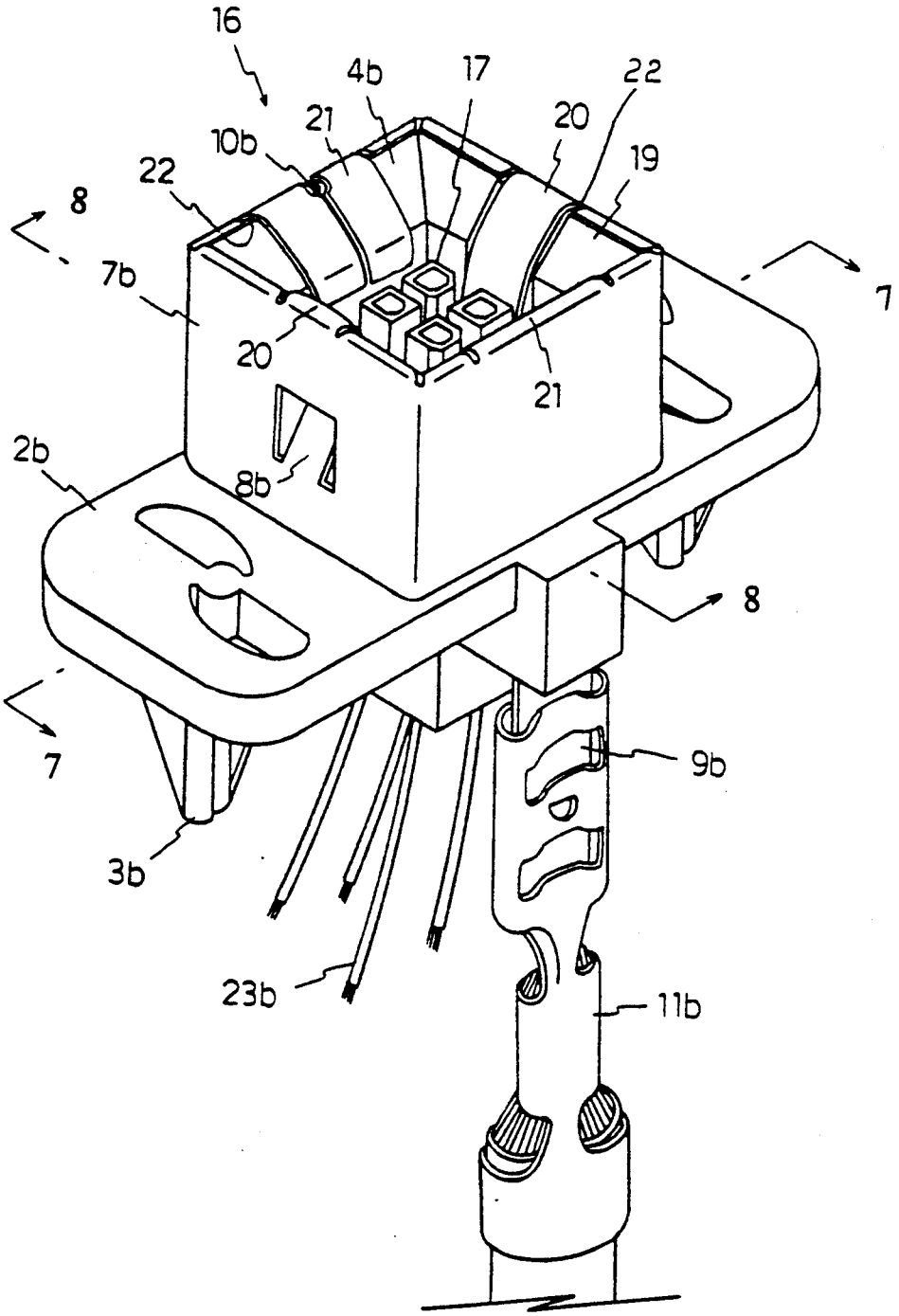
FIG. 2 is a perspective view of a female receptacle connector according to the present invention.

FIG. 2 shows a female receptacle 16 according to the present invention. It is similar to male plug 1 in that it has a rectangular base 2*b*, and the base 2*b* has attaching means 3*b* identical to those of plug 1 on its rear surface for fixing the receptacle to a panel, a board or a housing of an associated electric apparatus.

The receptacle has a square hollow housing 4*b* on center of the front surface of the base. As seen from FIG. 2, the square housing 4*b* has four square projections 17, and each projection 17 has an electrical signal transmission female terminal 6*b* therein (FIG. 3).

Figure 7:
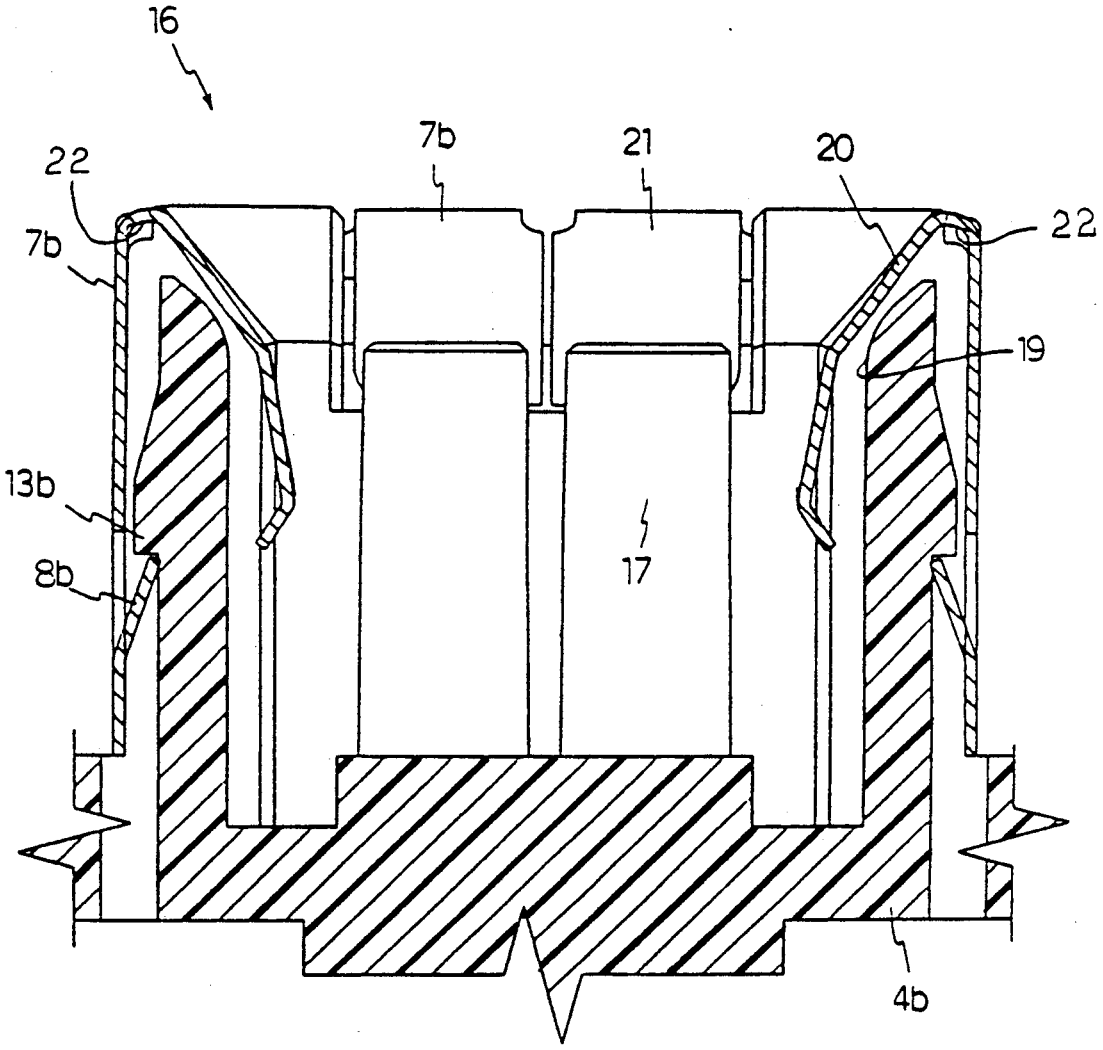
FIG. 7 is a longitudinal section of the receptacle taken along the line 7—7 in FIG. 2.

The square housing 4*b* has a surrounding square metal shell 7*b*. This square metal shell 7*b* may be made by folding a sheet metal to enclose the square housing 4*b*, and the metal shell 4*b* has two opposite tongues 8*b* cut and bent inward on its opposite sides. These tongues 8*b* will be caught by the corresponding projections 13*b* of the square housing 4*b* when the metal shell 7*b* is press-fitted around the square housing 4*b* (FIG. 7). The square shell 7*b* also has an metal blade contact 9*b* integrally connected thereto, as described later in detail. The metal shell 7*b* is press-fitted around the square housing 4*b* with its joint 10*b* positioned opposite to its blade contact 9*b*.

Figure 8:
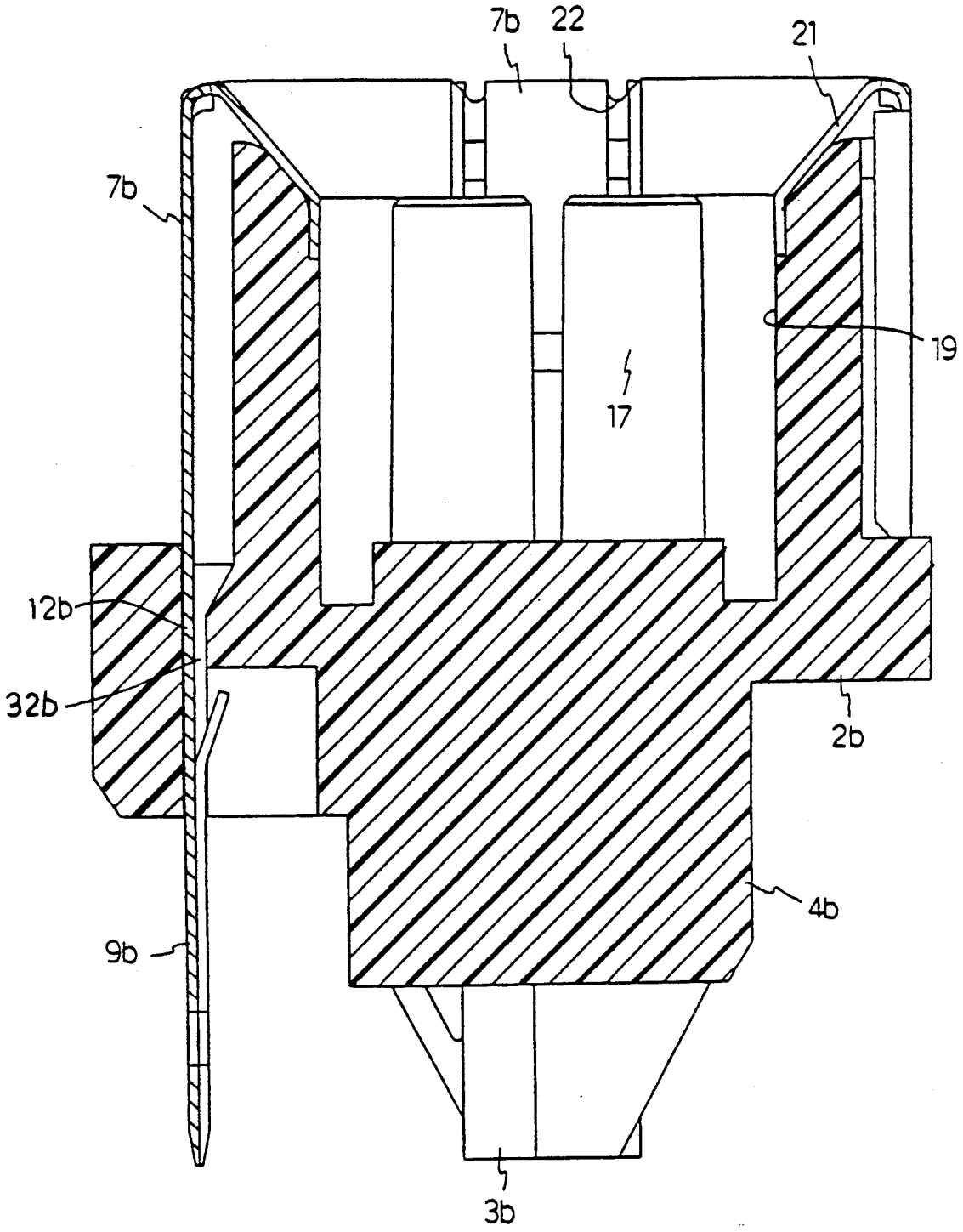
FIG. 8 is a longitudinal section of the receptacle taken along the line 8—8 in FIG. 2.

The metal shell 7*b* extends beyond the electrical signal transmission female terminals 6*b*, and the blade contact 12*b* of the metal shell 7*b* can be mated with an associated female terminal 11*b*. As seen from FIGS. 2 and 8, the end 9*b* of blade contact 12*b* passes through the blade contact holding slot 32*b* of the base 2*b*, depending down vertically from the base 2*b* and mating with the female terminal 11*b* for electrical connection.

As seen from FIG. 2, contact-making spring fingers 20 are integrally formed from shell 7*b* at opposite edges of the square housing 4*b*. These spring fingers 20 extend away from shell 7*b* and then are bent toward the inside wall 19 of the square housing 4*b*, thus permitting good resilient contact between the metal shell 7*a* of the plug 1 when the plug 1 is inserted into the receptacle 16. On the other hand, holding spring fingers 21 are integrally formed from shell 7*b* at the remaining opposite edges of the square housing 4*b*. These spring fingers 21 are bent inward depending from the opposite edges of the square housing 4*b* to secure further the shell 7*b* to housing 4*b*.

These contact-making and holding spring fingers 20 and 21 are bent inward along recesses 22 of the housing 4*b*. All electrical signal transmission female terminals 6*b* in the receptacle housing 4*b* are connected to conductors 23*b* to transmit electrical signals to an associated electrical apparatus, to which the receptacle 16 is fixed in a floating manner.

In use, the male plug 1 is fixed to an associated electric apparatus by fitting its fixing means 3*a* in the holding apertures of the electric apparatus to hold the plug in a floating condition. The female receptacle 16 is floatingly fixed to an associated electric apparatus by fitting its fixing mans 3*b* in the holding apertures of the electric apparatus. As seen from FIG. 3, the receptacle 16 includes extra fixing means 30.

To couple the plug 1 with the receptacle 16, the metal shell 7*a* and housing 4*a* of the plug 1 are press-fitted into the hollow housing 4*b* of the receptacle 16. The contact-making beams 20 of the receptacle 16 contact the metal shell 7*a* of the plug 1 before the plug and receptacle are completely coupled together. It is preferable that the coupling is effected with the blade contacts 9*a* and 9*b* of the plug 1 and receptacle 16 lying on the same side. Thus, associated electric apparatuses are electrically connected together by coupling the counterparts 1 and 16 of the electric connector.

The female terminal 11*a* associated with the plug 1 is electrically connected to the female terminal 11*b* associated with the receptacle 16 by connecting the metal shell 7*b* of the receptacle 16 by connecting the metal shell 7*a* of the receptacle 16 and the metal shell 7*a* of the plug 7*a* to each other through the agency of the contact-making spring fingers 20 and the blade contacts 9*a* and 9*b* of these counterparts 1 and 16, thus attaining the grounding of the associated electric apparatuses and, at the same time, the discharging of the static electricity from a person handling the electric connector prior to coupling together the electric signal transmission terminals of the counterparts 1 and 16. A good electrical connection between the metal shells 7*a* and 7*b* of the counterparts 1 and 16 is assured by the resiliency of the contact-making spring fingers 20.

As may be understood, the metal shell-and-blade contact terminal integral structures of these plug and receptacle counterparts 1 and 16 are used for grounding and destaticizing in common, and such an integral structure facilitates manufacturing and assembling, and permits a size reduction for the electric connector.

The contact-making beams 20 are bent over the tapered, lead-in surface of the housing wall of the receptacle 16, thereby permitting the smooth fitting of the male housing in the female housing even if the male housing is somewhat misaligned with respect to the female housing. This is particularly advantageous to the press-fitting of the floating plug in the receptacle of the electric connector. Also, the floating attachment is advantageous to the destaticization by coupling the metal shells 7*a* and 7*b* of the counterparts 1 and 16.

The contact-making and holding spring fingers 20 and 21 of the receptacle 16 are made flush with the edge of the metal shell 7*b* of the female housing by bending these fingers across the edge recesses of the metal shell, thus providing smooth edge surface on the whole edge length of the metal shell of the receptacle. Therefore, there is minimal risk for fingers being caught in handling the electric connector. Likewise, the upper folded edge of the metal shell 7*a* of the plug 1 are fitted in the space delimited by the recess of the male housing 5. The upper folded edge of the metal shell 7*a* provides a round smooth surface. Likewise, there is minimal risk for fingers being caught in handling the electric connector.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In a floating electrical connector for floatable mounting to a generally planar member, said generally planar member having at least one mounting aperture therein, said connector including a dielectric body, said body having a generally planar mounting flange, means extending from said flange for floatable mounting of a portion of said body in said aperture, and a terminal-receiving housing projecting from said flange, said housing including a plurality of terminal-receiving apertures with a terminal mounted in each said aperture, and contact portions of said terminals extending away from said flange in a direction generally perpendicular to the plane thereof a predetermined distance, said contact portions of said terminals adapted for mating with complementary terminals of a mating connector, wherein the improvement comprises:

a metal shell substantially encircling the center periphery of said housing and extending away from said flange a distance greater than said predetermined distance that the terminals extend away from said flange; and a generally planar metal blade contact integrally formed with said metal shell and at least a portion of which extends in a direction generally perpendicular to said flange, said blade extending from one side of said flange to the other in order to permit interconnection to a wire on a side of said flange opposite said housing;

wherein said metal blade contact extends through a slot in said flange; and wherein said housing includes a plurality of walls projecting away from said flange to create a central recess in which a plurality of terminal receiving projections are located, each said terminal receiving projection having a respective said contact portion therein, each said wall including a tapered lead-in surface sloping towards said projections, and said metal shell including at least one resilient, cantilevered spring finger for contacting a metal shell of a complementary mating connector, said spring finger extending along one of said tapered lead-in surfaces and into said recess between one of said walls and said projections.

2. The electrical connector of claim 1 wherein said metal shell includes a pair of said spring fingers, said spring fingers being positioned in channels in said lead-in surfaces so that top surfaces of said spring fingers are at or below the level of said lead-in surfaces.

3. The electrical connector of claim 2 wherein said floatable mounting means includes a support post extending generally perpendicularly from said flange, a pair of inwardly deflectable, spiral vanes extending from opposite sides of said support post.

* * * * *

UNITED STATES PATENT AND TRADEMARK OFFICE

CERTIFICATE OF CORRECTION

PATENT NO. : 5,286,222

DATED : Feb. 15, 1994

INVENTOR(S) : Masanori Yagi, et al

It is certified that error appears in the above-identified patent and that said Letters Patent is hereby corrected as shown below:

On title page, item [73] add the following:

--Canon Kabushiki Kaisha, Tokyo, Japan

Signed and Sealed this

Seventeenth Day of September, 1996

Bruce Lehman

*Attest:*

BRUCE LEHMAN

*Attesting Officer*

*Commissioner of Patents and Trademarks*